US005614710A

United States Patent [19]

Mondie et al.

[11] Patent Number: 5,614,710

[45] Date of Patent: Mar. 25, 1997

[54] DICHOTOMOUS SCAN SYSTEM FOR DETECTION OF OVERLAPPED OBJECTS

[75] Inventors: George R. Mondie, Bedford; Richard G. Van Tyne, Richardson; Marion W. Neff, Dallas, all of Tex.

[73] Assignee: ElectroCom Automation L.P., Arlington, Tex.

[21] Appl. No.: 477,651

[22] Filed: Jun. 7, 1995

[51] Int. Cl.[6] ..... G06M 7/10

[52] U.S. Cl. ..... 250/223 R; 377/8

[58] Field of Search ..... 250/223 R; 377/8, 377/30, 53

[56] References Cited

U.S. PATENT DOCUMENTS

| | | | |
|---|---|---|---|
| 3,278,754 | 10/1966 | Wallace . | |
| 3,283,163 | 11/1966 | Folmar . | |
| 3,414,732 | 12/1968 | Stegenga . | |
| 3,614,419 | 10/1971 | Daughton | 250/223 R |
| 3,737,666 | 6/1973 | Dutro | 250/223 R |
| 3,892,492 | 7/1975 | Eichenberger . | |
| 4,217,491 | 8/1980 | Dufford et al. | 250/223 R |
| 4,286,149 | 8/1981 | Ben-Nathan et al. | 250/223 R |
| 4,450,352 | 5/1984 | Olsson | 250/223 R |

OTHER PUBLICATIONS

Article: *IBM Technical Disclosure Bulletin*, vol. 6, No. 10 (Mar. 1964), Overlapped Document Detector, J.K. Mullin, p. 52.

*Primary Examiner*—Edward P. Westin
*Assistant Examiner*—Kevin Pyo
*Attorney, Agent, or Firm*—Harold E. Meier

[57] ABSTRACT

Apparatus and method are disclosed for detection of overlapped objects moving along a defined path. A light radiation source directs a light beam toward the path. As an object moves into the light beam, reflected light is received by two light sensors. An edge of an overlapping object moving along the defined path substantially blocks the light reflected from the underlying object from being received by one light sensor. The edges of an overlapping object are detected when a there is a difference in the amount of reflected light received by the light sensors and there exists a substantial rate of change in the amount of reflected light (indicative of a true edge of an overlapping object as opposed to warps, wrinkles, creases, etc. on the surface of an object) received by either light sensor due to the substantial blockage of reflected light by the edge.

20 Claims, 12 Drawing Sheets

| | EDGES | | | | | | OTHER FEATURES | | | | | | | | | | |
|---|---|---|---|---|---|---|---|---|---|---|---|---|---|---|---|---|---|
| | TBL | TBT | BL | L | BT | T | ND | B | W | WB | BW | WR | WF | WBWR | WBWF | XDR | XDF |
| Signal | | | | | | | | | | | | | | | | | |
| CO | 0 | 0 | 0 | 0 | 0 | 0 | 1 | 0 | 0 | 0 | 0 | 0 | 0 | 0 | 0 | 0 | 0 |
| A-B | 1 | 0 | 1 | 1 | 0 | 0 | * | 0 | 0 | 0 | 0 | 1 | 0 | 1 | 0 | 1 | 0 |
| B DIFF | 1 | 0 | 1 | 0 | 0 | 0 | * | 0 | 0 | 0 | 0 | 0 | 0 | 1 | 1 | 1 | 0 |
| B BLK | 0 | 0 | 1 | 1 | 0 | 0 | * | * | 0 | * | 0 | 0 | 0 | 0 | 0 | Z | 0 |
| B-A | 0 | 1 | 0 | 0 | 1 | 1 | * | 0 | 0 | 0 | 0 | 0 | 1 | 0 | 1 | 0 | 1 |
| A DIFF | 0 | 1 | 0 | 0 | 1 | 0 | * | 0 | 0 | 0 | 0 | 0 | 0 | 1 | 1 | 0 | 1 |
| A BLK | 0 | 0 | 0 | 0 | 1 | 1 | * | * | 0 | * | 0 | 0 | 0 | 0 | 0 | 0 | Z |

1 - Active; 0 - Inactive; * - 0 or 1, don't care; X - 1 if surface transition is sharp (creased), 0 otherwise;
Y - 1 if white-to-black transition and sharp surface transition coincide, 0 otherwise;
Z - 1 if deformation is tall enough so that one sensor receives nearly zero light from the beam spot, 0 otherwise.

LEGEND

| | | |
|---|---|---|
| ND | - | No document present (shown in FIGURE 1) |
| B | - | Flat black surface (shown in FIGURE 3) |
| W | - | Flat white surface (shown in FIGURE 3) |
| WB | - | Flat surface, transition from white to black (shown in FIGURE 3) |
| BW | - | Flat surface, transition from black to white (shown in FIGURE 3) |
| TBL | - | Begin lead edge, very thin object (shown in FIGURE 4) |
| BL | - | Begin lead edge, other than thin object (shown in FIGURE 4) |
| L | - | Steady state, lead edge (shown in FIGURE 4) |
| TBT | - | Begin trail edge, very thin object (shown in FIGURE 5) |
| BT | - | Begin trail edge, other than thin object (shown in FIGURE 5) |
| T | - | Steady state, trail edge (shown in FIGURE 5) |
| WR | - | Wrinkle or warp, rising surface (shown in FIGURE 7) |
| WF | - | Wrinkle or warp, falling surface (shown in FIGURE 8) |
| WBWR | - | White to black transition coincident with wrinkle or warp, rising surface (shown in FIGURE 9) |
| WBWF | - | White to black transition coincident with wrinkle or warp, falling surface (shown in FIGURE 10) |
| XDR | - | Extreme deformation, rising surface (shown in FIGURE 11) |
| XDF | - | Extreme deformation, falling surface (shown in FIGURE 11) |

FIGURE 6A

| | EDGES | | | | | | OTHER FEATURES | | | | | | | | | | |
|---|---|---|---|---|---|---|---|---|---|---|---|---|---|---|---|---|---|
| | TBL | TBT | BL | L | BT | T | ND | B | W | WB | BW | WR | WF | WBWR | WBWF | XDR | XDF |
| Signal | | | | | | | | | | | | | | | | | |
| CO | 0 | 0 | 0 | 0 | 0 | 0 | 1 | 0 | 0 | 0 | 0 | 0 | 0 | 0 | 0 | 0 | 0 |
| A-B | 1 | 0 | 1 | 1 | 0 | 0 | * | 0 | 0 | 0 | 0 | 1 | 0 | 1 | 0 | 1 | 0 |
| B DIFF | 1 | 0 | 1 | 0 | 0 | 0 | * | 0 | 0 | 0 | 0 | 0 | 0 | Y | 0 | 1 | 0 |
| B BLK | 0 | 0 | 1 | 1 | 0 | 0 | * | * | 0 | * | 0 | 0 | 0 | 0 | 0 | Z | 0 |
| B-A | 0 | 1 | 0 | 0 | 1 | 1 | * | 0 | 0 | 0 | 0 | 0 | 1 | 0 | 1 | 0 | 1 |
| A DIFF | 0 | 1 | 0 | 0 | 1 | 0 | * | 0 | 0 | 0 | 0 | 0 | 0 | 0 | Y | 0 | 1 |
| A BLK | 0 | 0 | 0 | 0 | 1 | 1 | * | * | 0 | * | 0 | 0 | 0 | 0 | 0 | 0 | Z |
| B1 DIFF | 1 | 0 | 1 | 0 | 0 | 0 | * | 0 | 0 | 1 | 0 | 0 | 0 | 1 | 1 | 1 | 0 |
| B2 DIFF | 1 | 0 | 1 | 0 | 0 | 0 | * | 0 | 0 | 0 | 0 | X | 0 | X | 0 | 1 | 0 |
| A1 DIFF | 0 | 1 | 0 | 0 | 1 | 0 | * | 0 | 0 | 1 | 0 | 0 | 0 | 1 | 1 | 0 | 1 |
| A2 DIFF | 0 | 1 | 0 | 0 | 1 | 0 | * | 0 | 0 | 0 | 0 | 0 | X | 0 | X | 0 | 1 |

1 - Active; 0 - Inactive; * - 0 or 1, don't care; X - 1 if surface transition is sharp (creased), 0 otherwise;
Y - 1 if white-to-black transition and sharp surface transition coincide, 0 otherwise;
Z - 1 if deformation is tall enough so that one sensor receives nearly zero light from the beam spot, 0 otherwise.

LEGEND

ND - No document present (shown in FIGURE 1)
B - Flat black surface (shown in FIGURE 3)
W - Flat white surface (shown in FIGURE 3)
WB - Flat surface, transition from white to black (shown in FIGURE 3)
BW - Flat surface, transition from black to white (shown in FIGURE 3)
TBL - Begin lead edge, very thin object (shown in FIGURE 4)
BL - Begin lead edge, other than thin object (shown in FIGURE 4)
L - Steady state, lead edge (shown in FIGURE 4)
TBT - Begin trail edge, very thin object (shown in FIGURE 5)
BT - Begin trail edge, other than thin object (shown in FIGURE 5)
T - Steady state, trail edge (shown in FIGURE 5)
WR - Wrinkle or warp, rising surface (shown in FIGURE 7)
WF - Wrinkle or warp, falling surface (shown in FIGURE 8)
WBWR - White to black transition coincident with wrinkle or warp, rising surface (shown in FIGURE 9)
WBWF - White to black transition coincident with wrinkle or warp, falling surface (shown in FIGURE 10)
XDR - Extreme deformation, rising surface (shown in FIGURE 11)
XDF - Extreme deformation, falling surface (shown in FIGURE 11)

FIGURE 6B

DICHOTOMOUS SCAN SYSTEM FOR DETECTION OF OVERLAPPED OBJECTS

TECHNICAL FIELD

The present invention relates to object detectors and, in particular, to an overlapped object detector for detecting an object overlapping another object.

BACKGROUND OF THE INVENTION

Many processes involve the transport of large quantities of items in a conveying system. In some of these processes, it is essential that each individual item be separated from the items immediately in front of and/or behind it. For such cases, imperfections in the apparatus that replace the items in the conveying system make it necessary and useful to develop a system capable of detecting two or more overlapping items, commonly referred to as multiples.

Various methods for detecting multiples have been devised. For items of consistent thickness, mechanical thickness sensing (and for thinner, translucent material, detection and measurement of the attenuation of a radiation source passing through the material) have been employed. For mixed items of highly variable thickness other strategies are required. Typical approaches used have included comparison of item length to maximum item length, attempted separation by vacuum, and measurement of length or height before and after applying opposed forces to the two sides of the object or objects.

While existing detection methods for items of consistent thickness can be quite reliable, existing methods for the detection of multiples in a stream of highly variable items have shortcomings. Comparing item length to a maximum only detects those multiples which overlap in such a way as to exceed the maximum single piece length. The more variation in length among the items, the less this strategy will be successful. Using vacuum to pull at both sides of an item in an attempt to separate the item into two parts (if it is in fact a multiple) is limited in higher speed applications or applications where there is considerable variation in item stiffness or mass. This approach also tends to be bulky and noisy. The use of opposing forces on the sides of the item in order to change its apparent length or height (if it is in fact a multiple) has the drawback that for many classes of materials, the use of a force necessary to break the static frictional force or other force that tended to create the multiple in the first place will tend to damage a large proportion of items. It is also difficult to successfully implement such a system for a wide range of thicknesses.

Detection of unwanted overlapping objects is extremely important in automatic mail transporting systems, and also in systems in which an overlapping object may cause jamming or stoppage of the system. Automatic mail transporting systems are utilized for the efficient handling and routing of virtually millions of pieces of mail. With systems that require mail pieces to be separated and singulated as they move along a path, such as the United States Postal Services system, detection of overlapping mail pieces after exiting an upstream feeder is very important. While these upstream feeders output a very low percentage of overlapping documents (commonly referred to as "multiples"), many users of such systems require an even lower percentage of multiples.

In some of these systems, 25 to 35 thousand mail pieces per hour are fed into a transport, read (via optical character recognition (OCR) or bar code), and then sorted. The effect of an undetected multiple is generally to cause a piece to be sorted to the wrong destination. Given the huge volume of mail processed in the United States alone (177 billion in 1994), even a small percentage of undetected multiples results in a large cost for rehandling and significant number of pieces delayed in reaching their destination. These mail streams generally contain items with a very wide range of thickness, height, length, stiffness, color, interference (print) and mass. As a consequence (and given the limitations of existing detection technologies), most mail automation systems scan for doubles detectable by an item in excess of a maximum length, making no effort to detect other multiples, and resulting in a small but significant percentage of missorted mail pieces.

The problem with present overlapping object detection systems is the inability to accurately detect overlapping objects that have been subjected to extensive handling or damage. The problem is that wrinkles and other small-scale distortions of the document surface can cause false edge indications. Since a large fraction of the mail processed by the U.S. Postal Service is typically sorted multiple times by hand and/or machine and is subject to damage during transport and processing, a practical device intended for use in processing this material must be able to discriminate between true edges and common surface deformations.

Accordingly, there is a need for an improved multiples detection technology for use in the handling of mail and other material which varies in mass, thickness and other physical characteristics. Further, there is a need for an improved overlapping object detector and new geometric dichotomous scanning technique capable of providing information on orientation, position and thickness of edges on the surface of an object that is accurate even when the surface is deformed or damaged. Such information can then be used to distinguish a true overlapping object from an object having a non-uniform surface. Additionally, there is a need for a low cost overlapping object detector of small-size to permit a plurality of such detectors to be installed within the object transport or feeder system and further, for a detector to scan both the upper and lower surfaces of the objects.

SUMMARY OF THE INVENTION

According to the present invention, an electro-optical overlapped object detector and method for detecting one object overlapping another object as the objects move along a defined path is provided. The electro-optical overlapped object detector comprises a light source for projecting a light beam toward the path and a first and second light sensor oriented to receive light reflected from the object passing through the light beam. The first and second light sensors output a first and second output signal, respectively, each having magnitudes related to the amount of reflected light received by the first and second light sensor, respectively. The overlapped object detector further generates a plurality of edge information signals in response to the first and second output signals. The plurality of edge information signals indicate one object overlapping another object when there exists both a difference in the amount of reflected light received by each of the first and second light sensors and a substantial rate of change in the amount of reflected light received by either the first or second light sensors when an edge of the overlapping object substantially blocks the reflected light from being received by either the first or second light sensors.

BRIEF DESCRIPTION OF THE DRAWINGS

A more complete understanding of the overlapped object detector of the present invention may be had by reference to the following detailed description in conjunction with the accompanying drawings wherein:

FIG. 6A is a truth table illustrating output signals corresponding to various surface features detected by the present invention as realized in the circuit shown in FIG. 2A;

FIG. 6B is a truth table illustrating output signals corresponding to various surface features detected by the present invention as realized in the circuit shown in FIG. 2B;

DETAILED DESCRIPTION

Figure 1:
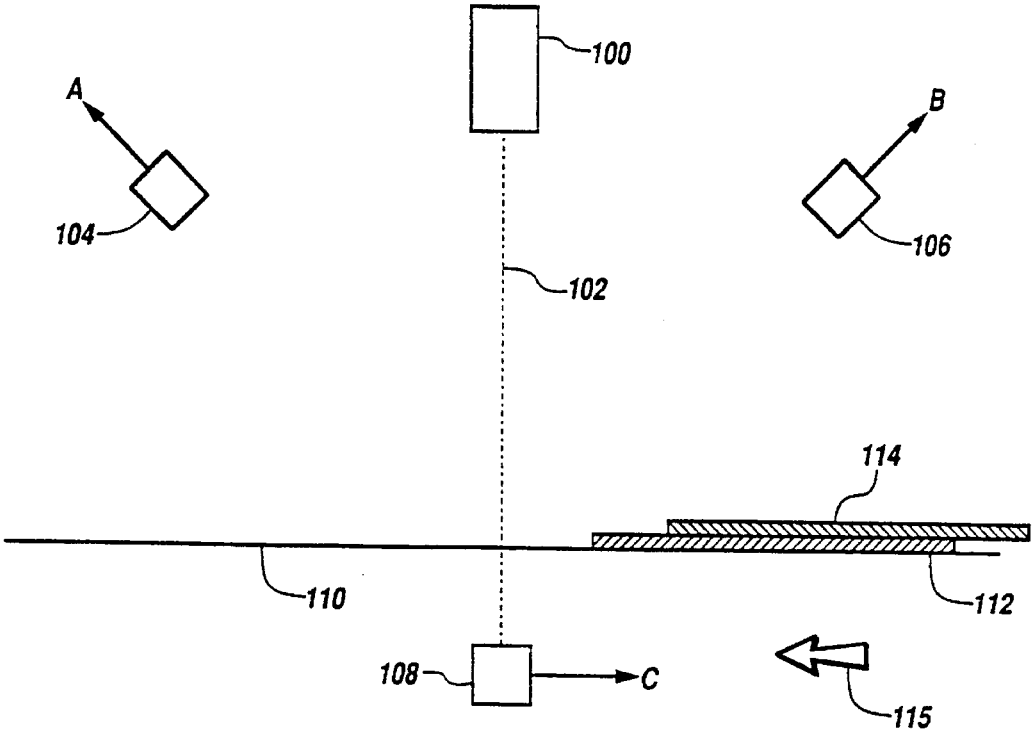
FIG. 1 illustrates the light source and three light sensors of an overlapping detector system of the present invention and a first object overlapping a second object as both objects move along a defined path.
Figure 2A:
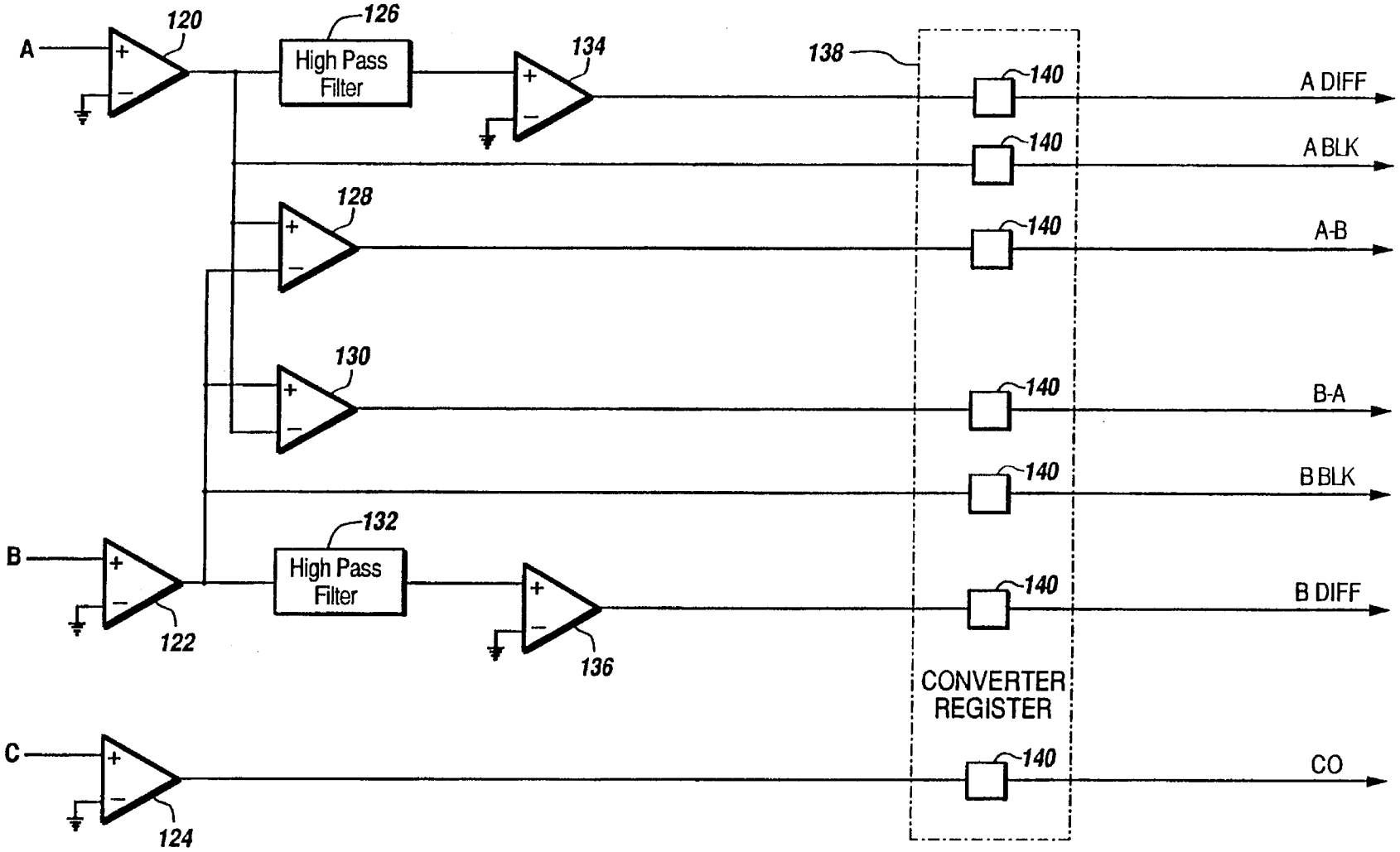
FIG. 2A is a schematic diagram of the circuitry for an overlapping detector system, the circuitry utilized in detecting overlapped objects.

Referring now to FIGS. 1 and 2A, there is illustrated the overlapped object detector of the present invention. As shown in FIG. 1, the overlapped object detector comprises a light source 100 outputting a light beam 102 directed toward a defined path 110. Preferably, the light source 100 is a laser diode emitting a collimated light beam 102, however, the light source may comprise any device which emits light or other types of radiation. The light beam 102 is directed to intersect the defined path 110 at a predetermined intersection point. An object 112 and an overlapping object 114 move along the defined path 110 in the direction as indicated in FIG. 1 by the arrow 115.

The overlapped object detector of the present invention further comprises a first light sensor 104 and a second light sensor 106 oriented to receive the light reflected from the surface of objects 112 and 114 as the objects pass through the light beam 102. The second light sensor 106 is positioned upstream from the light beam 102 and the first light sensor 104 is positioned downstream from light beam 102. A third light sensor 108 is positioned below the defined path 110 to receive the light beam 102 directly from the light source 100. As an object moves along the defined path 110, the object blocks the light beam 102 from being received by the third light sensor 108. Preferably, the first, second and third light sensors each comprise a photodiode, but any device which senses or detects light or any other types of radiation emitted from the light source 100 can be used. Each of the first, second and third light sensors generates an electrical output signal, signal A, B and C, respectively, in response to the amount of light received by the respective light sensor.

With further reference to FIG. 2A, there is shown circuitry receiving output signals A, B, and C. Each signal A, B and C is amplified by one of the amplifiers 120, 122 and 124, respectively. The output signal of the amplifier 120 is input to a first high pass filter 126, a first differential amplifier 128, a second differential amplifier 130 and a converter register 138. The output signal of amplifier 122 is input to a second high pass filter 132, the first differential amplifier 128, the second differential amplifier 130 and the converter register 138. The output signal of amplifier 124 is input to the converter register 138. The converter register 138 comprises a plurality of converters 140 for converting any inputs to the converter register 138 into digital signals.

The first filter 126 and an amplifier 134 coupled to the output thereof function together to detect a rate of change in the output of the first light sensor 104 (signal A) which exceeds an empirically based threshold. The output of amplifier 134 is then input to the converter register 138. The second filter 132 and an amplifier 136 coupled to the output thereof function together to detect a rate of change in the output of the second light sensor 106 (signal B) which exceeds an empirically based threshold. The output of amplifier 136 is then input to the converter register 138.

Figure 2B:
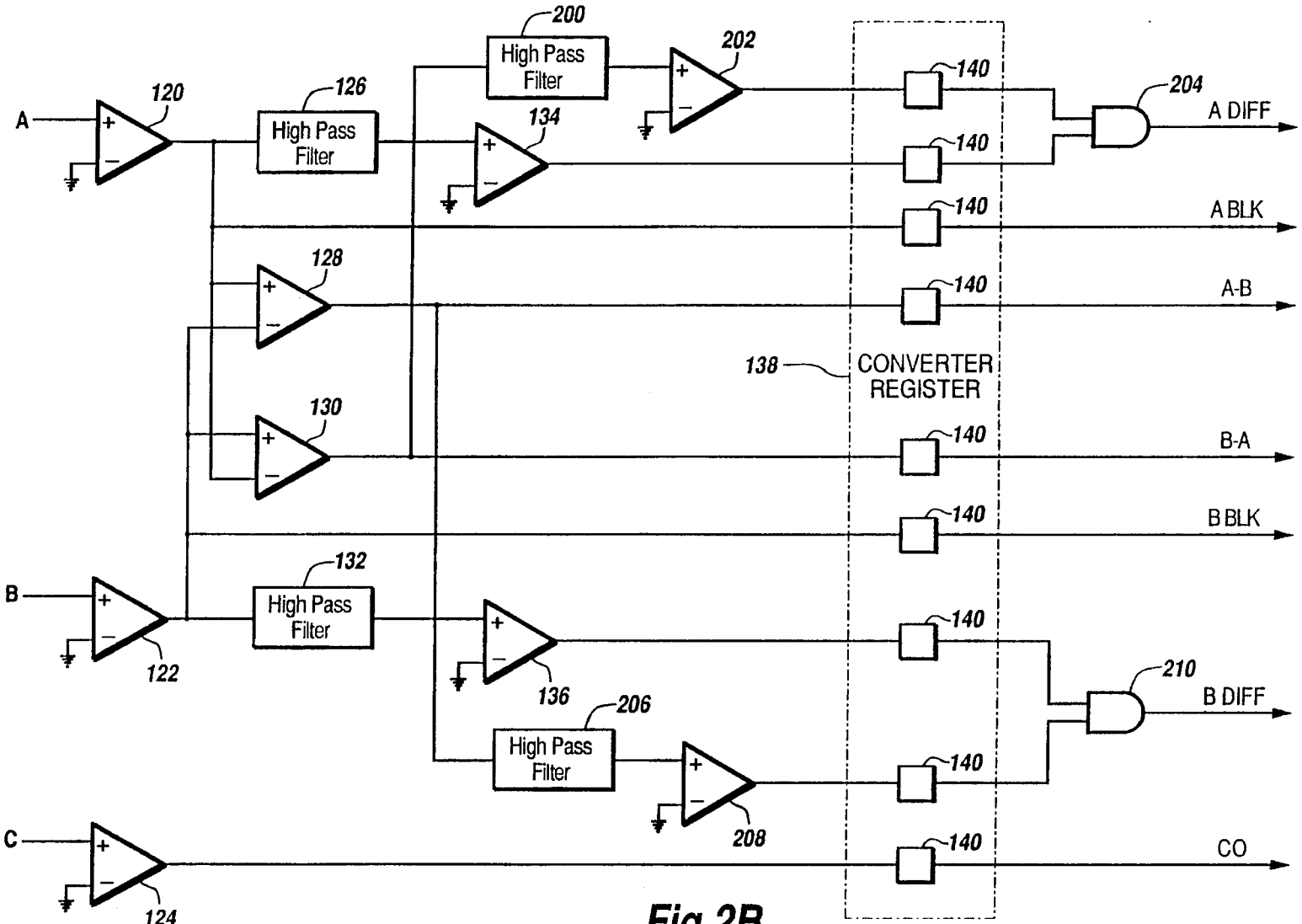
FIG. 2B is a schematic diagram of an alternative embodiment of the circuitry for the overlapping detector system, the circuitry utilized in detecting overlapped objects.

While the present invention as shown in FIG. 2A satisfactorily produces the desired results in most applications, it has been determined that in certain applications additional circuitry is needed. In applications where the surface of an object may contain special combinations of features as herein described below, a circuit as shown in FIG. 2B may be required.

Now referring to FIG. 2B, the circuitry of FIG. 2A is modified by the addition of two intermediate signal paths as follows: The output signal of the amplifier 128 is additionally input to a high-pass filter 206, with the output thereof coupled to an amplifier 208. The output of the amplifier is input to the converter register 138. The output of the amplifier 208 (converted to digital logic levels by the converter register 138) and the output of the amplifier 136 (converted to digital logic levels) are input to an AND gate 210 to generate the signal "B DIFF". Likewise, the output signal of the amplifier 130 is additionally input to a high-pass filter 200, with the output thereof coupled to an amplifier 202. The output of the amplifier 202 is input to the converter register 138. The output of the amplifier 202 (converted to digital logic levels) and the output of the amplifier 134 (converted to digital logic levels) are input to an AND gate 204 to generate the signal "A DIFF".

The present invention generates seven edge information signals for detecting the existence of an overlapping object as shown in FIG. 1. Now referring to FIG. 2A and FIG. 2B, signal "A-B" is defined as the differential amplification of signal A minus signal B whereby signal "A-B" is a logic high when the amount of reflected light received by the first light sensor 104 is significantly greater than the amount of reflected light received by the second light sensor 106. Conversely, signal "B-A" is logic high when the amount of reflected light received by the second light sensor 106 is significantly greater than the amount of reflected light received by the first light sensor 104.

Referring now to FIG. 2A, signal "A DIFF" and signal "B DIFF" are defined as the thresholded rates of change in signals generated directly by the first light sensor 104 and second light sensor 106, respectively. Signal "A DIFF" is active (logic "1") only during the rapid transition of the output from the first light sensor 104 from high to low (from illuminated to dark). Likewise, signal "B DIFF" is active (logic "1") only during the rapid transition of the output from the second light sensor 106 from high to low (from illuminated to dark).

Referring now to FIG. 2B, signal "A DIFF" is defined as the composite rate of change in signals generated directly by the first light sensor 104 and by the differential amplifier 128. Signal "B DIFF" is defined as the composite rate of change in signals generated directly by the second light sensor 106 and by the differential amplifier 130. Signal "A DIFF" is active (logic "1") when signal "A1 DIFF" and signal "A2 DIFF" are both active. Signal "A1 DIFF" is active only during the rapid transition of the output from the first light sensor 104 from high to low (from illuminated to dark). Signal "A2 DIFF" is active only during the rapid transition from low to high of the signal from the differential amplifier 130. The differential amplifier 130 outputs the amplified result of subtracting the output of the first light sensor 104 from the output of second light sensor 106.

Likewise, signal "B DIFF" is active (logic "1") when signal "B1 DIFF" and signal "B2 DIFF" are both active. Signal "B1 DIFF" is active only during the rapid transition of the output from the second light sensor 106 from high to low (from illuminated to dark). Signal "B2 DIFF" is active only during the rapid transition from low to high of the signal from the differential amplifier 128. The differential amplifier 128 outputs the amplified result of subtracting the output of the second light sensor 106 from the output of first light sensor 104.

Now referring to FIGS. 2A and 2B, signal "A BLK" and signal "B BLK" are defined as the "raw" signals A and B, respectively. Signals "A BLK" and "B BLK" are individually logic high when the amount of reflected light received by the first or second light sensors 104, 106 is nearly zero. That is, when a nearly zero amount of reflected light is detected at the first light sensor 104, signal "A BLK" is logic high. Further, when a nearly zero amount of reflected light is detected at the second light sensor 106, signal "B BLK" is logic high.

Figure 12:
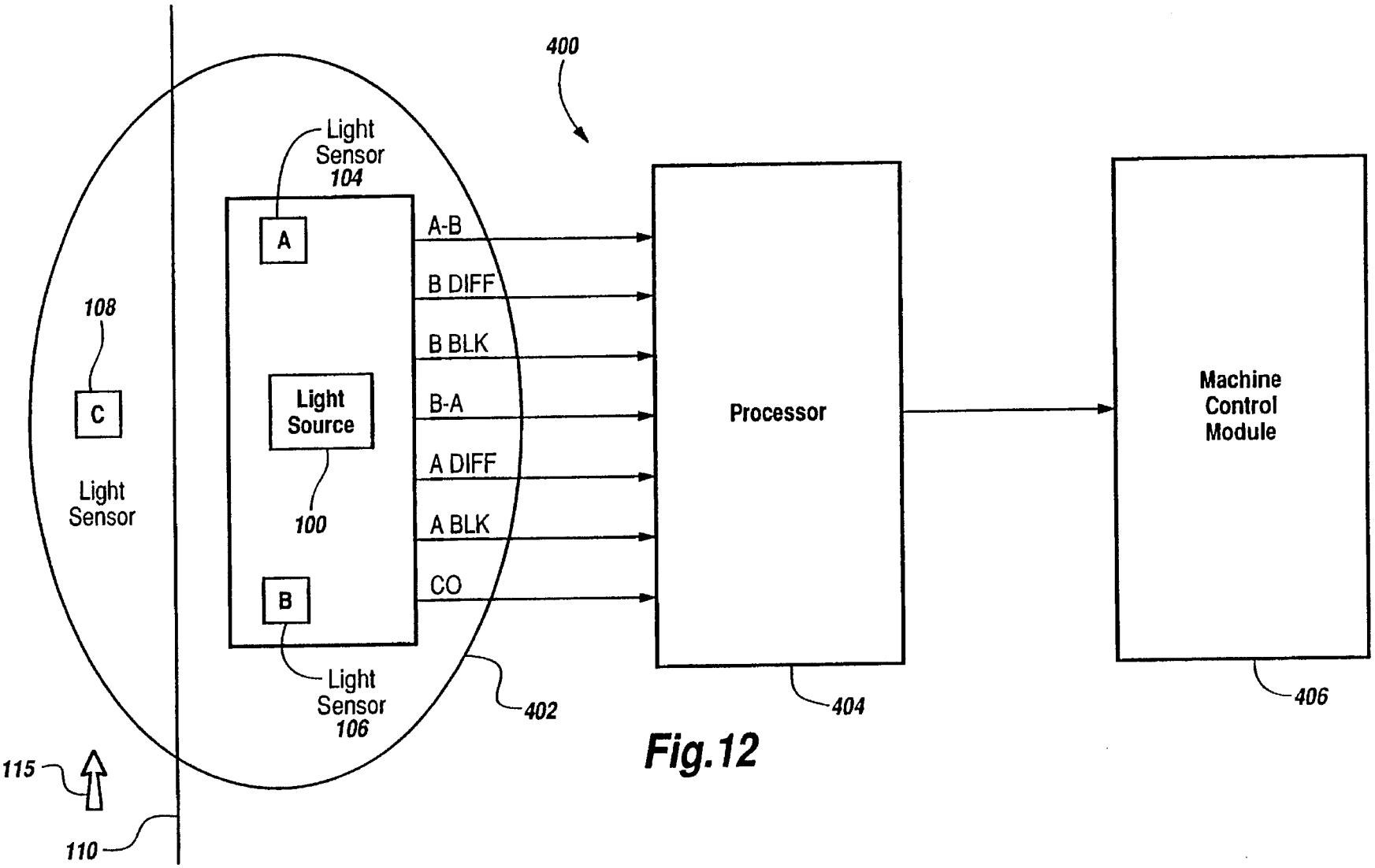
FIG. 12 illustrates a preferred embodiment of the dichotomous scan overlapping object detection and analysis system in accordance with the present invention.

Referring now to FIG. 12, there is illustrated a dichotomous scan detection system 400 in accordance with the present invention. The dichotomous scan detection system 400 includes a scan assembly 402, a processor 404 and a control module 406. The scan assembly 402 includes the light source 100, the first, second and third light sensors 104, 106 and 108, and the circuitry shown in FIG. 2A or FIG. 2B. The scan assembly 402 outputs the seven signals to the processor 404. The seven output lines of the scan assembly 402 transmit parallel binary information about material being scanned to the processor 404.

The processor 404, comprising software, firmware or hard-wired logic (or a combination of these), interprets the states of the seven edge information signals to 1) determine the presence of interesting features, especially edges; 2) associate those features to identify the presence of such physical items as labels, windows, folds, overlaps etc.; and 3) use the resulting information that describes the physical surface of an item to generate control signals of decision data that are input to the control module 406 to control additional processing machines or equipment. As such, the dichotomous scan detection system 400 is shown in the context of a system fully capable of detecting and acting on the presence of overlapping documents.

Referring now to FIG. 1, there is shown object 112 and overlapping object 114 moving along the defined path 110 and positioned upstream of the light beam 102. Since the light beam 102 is not projected onto a surface of an object, the third light sensor 108 directly receives the light beam 102. Therefore, the output signal C of sensor 108 is amplified by amplifier 124 (FIG. 2A) resulting in signal "CO" being active, that is, = logic "1". As an object moves along the defined path in the direction of the arrow 115 it blocks the light beam 102 from being received by the third light sensor 108 and the signal "CO" transition to an inactive state, that is, logic "0". When the signal "CO" is a logic "1" it indicates that the other six edge information signals are not valid due to the nonexistence of an object at the detection station.

Referring now to FIGS. 6A, 6B and 12, there are shown two truth tables illustrating the output signals corresponding to various surface features detected by the doubles detector of the present invention using the circuitry depicted in FIG. 2A and FIG. 2B, respectively. FIGS. 6A and 6B relate the occurrence of the above conditions and others described below to the states of the seven output signals of the scan assembly 402. The signal states in each column of the tables are interpreted by the processor 404 to determine the indicated feature type. The above feature type as shown in FIG. 1 is given by signal "CO" = logic "1" and is defined (without reference to any other signal states) as "No Document Present" and is indicated as feature "ND" in the truth tables.

Figure 3:
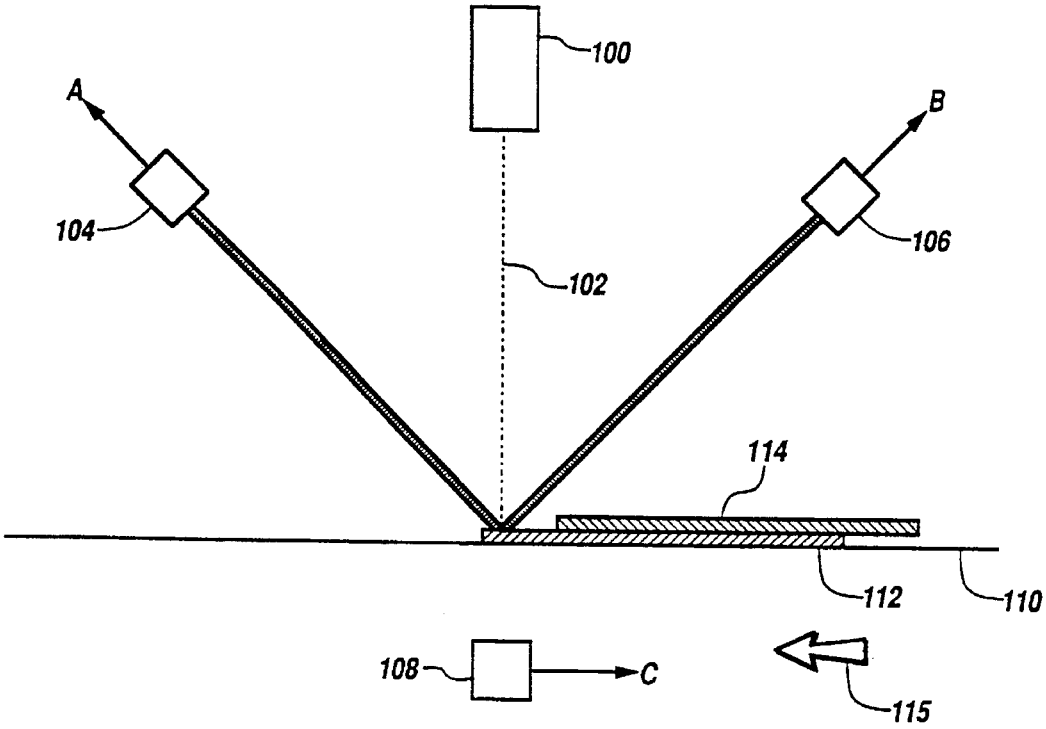
FIG. 3 illustrates an overlapped object as an underlying object passes through the light beam projected by the light source.

Referring now to FIG. 3 and with continued reference to FIGS. 2A and 2B, the object 112 is shown along with the overlapping object 114 positioned along the defined path 110 whereby the light beam 102 is projected onto the surface of the object 112. The overlapping object 114 may be a separate item (as shown) or may be a feature (such as a label) associated with the object 112. The light beam 102 is blocked from the third light sensor 108 and signal "CO" = logic "0" indicating an object is present at the detection station and that the other six edge information signals are valid. The first and second light sensors 104, 106 each receive some light reflected from the surface of the object 112. Edge information signal "A-B" = logic "0" and signal "B-A" = logic "0" since the amount of reflected light received by the light sensors 104 and 106 is about equal.

Referring again to FIGS. 6A and 6B, the truth tables show the output signals of the scan assembly 402 that result from the condition of FIG. 3 and the states are defined as "Flat Black Surface" indicated as feature "B", "Flat White Surface" indicated as feature "W" "Flat Surface, Transition from White to Black" indicated as feature "WB" and "Flat Surface, Transition from Black to White" indicated as feature "BW". The "Black" term denotes printed matter or characters on the surface of the object 112 (such as names, addresses, etc. on an envelope). These four features do not provide any 3-dimensional or depth information. Note that in none of these cases is either signal "A-B" or signal "B-A" in an active (logic "1") state. The processor 404 receiving the signal "A-B" and the signal "B-A" does not consider any other signals when both signals "A-B" and "B-A" are inactive (logic "0"). As such, when both signals "A-B" and "B-A" equal logic "0", the scan assembly 402 is detecting either a "B" "W" "WB" or "BW" feature (no edge, crease, wrinkle, etc.).

Figure 4:
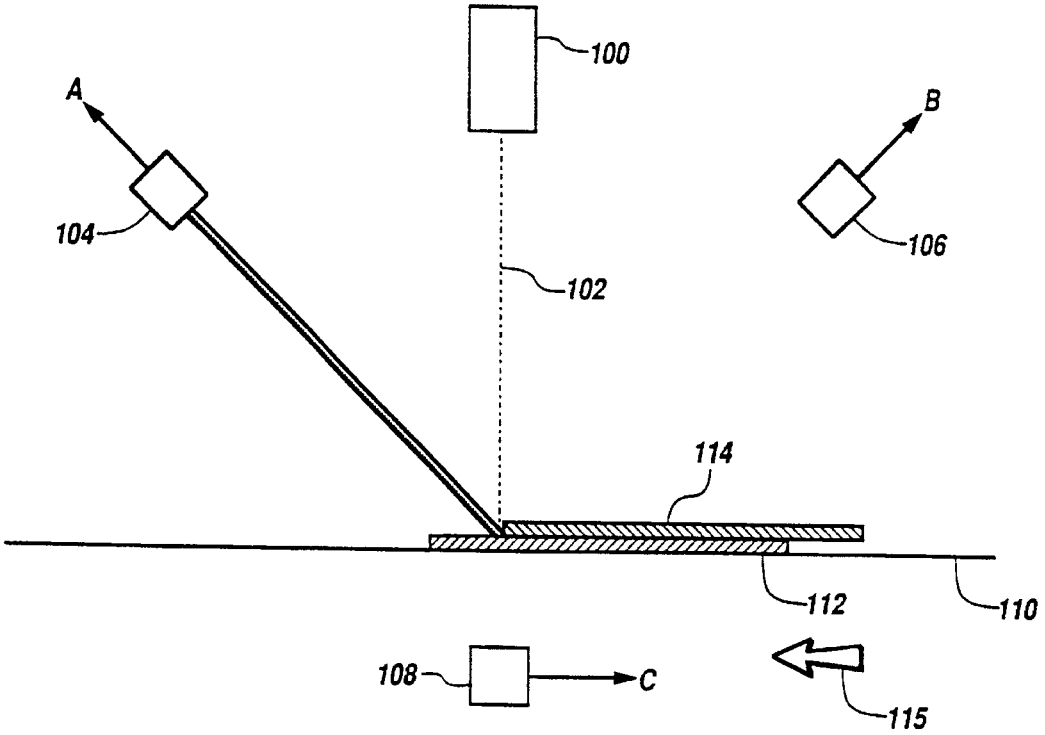
FIG. 4 illustrates the detection of the leading edge of overlapping objects.

Referring now to FIG. 4 and with continued reference to FIGS. 2A, 2B, 6A and 6B, there is shown the object 112 and a leading edge 107 of an overlapping object 114. The overlapping object 114 may be an object similar to object 112 or may be something (such as a label) affixed to or associated with the surface of the object 112. As the objects 112 and 114 move along the defined path 110, a point is reached where the leading edge 107, defined by the object 114, is about to pass through the light beam 102. If the object 114 forms an edge whose height (thickness) is comparable to or greater than the diameter of the beam 102, the reflection of the beam 102 will briefly be invisible to the second light sensor 106. As such, the second light sensor 106 will receive little or no reflected light and the output of the second light sensor 106 will be reduced to zero or near zero causing signals "A-B" and "B BLK" to become active.

In addition, the rate of the transition to zero (or near zero) of the output of the second light sensor 106 will be sufficiently rapid to cause signal "B DIFF" to briefly become active. If the edge is sufficiently thick, the signals "A-B" and "B BLK" will remain active after the signal "B DIFF" has returned to the inactive state. The output signals resulting from this situation are shown in FIGS. 6A and 6B as the features defined as "Begin lead edge, other than thin object" indicated as feature "BL" and "Steady state, lead edge" indicated as feature "L".

With continued reference to FIGS. 4, 2A, 2B, 6A and 6B, if the edge thickness is significantly less than the diameter of the beam 102, the output of the second light sensor 106 will be briefly reduced, but not to zero or near zero. In this case, the signals "A-B" and "B DIFF" will become active, but signal "B BLK" will not become active. The output signals resulting from this situation are given in FIGS. 6A and 6B under the feature defined as "Begin lead edge, very thin object" indicated as feature "TBL".

Figure 5:
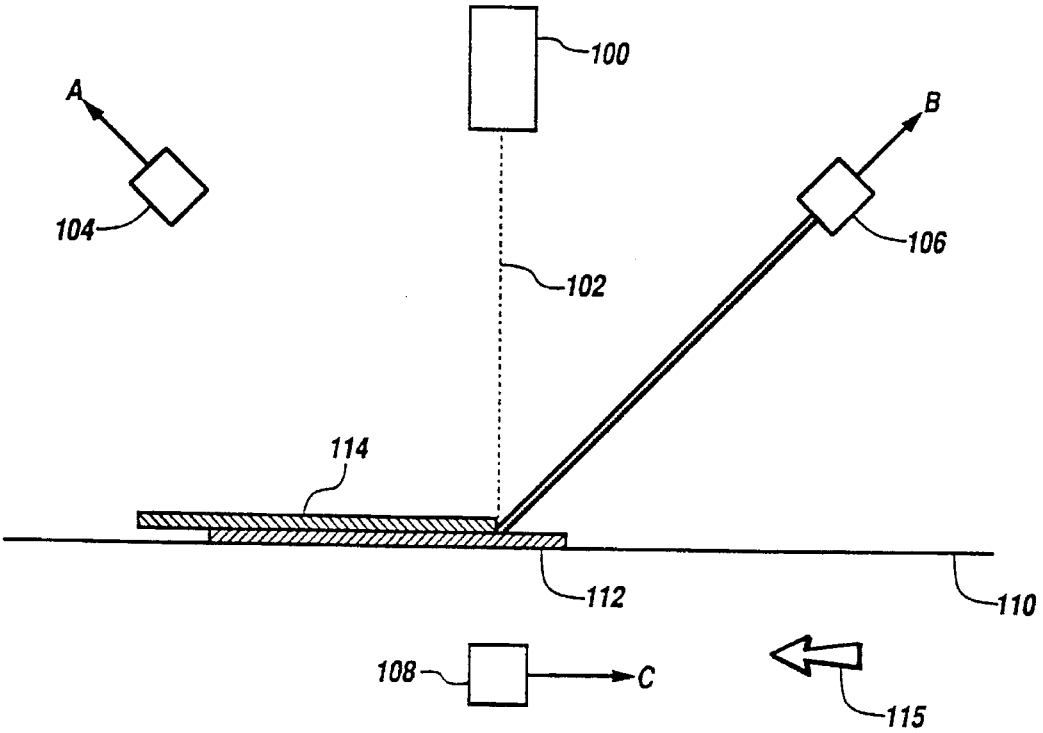
FIG. 5 illustrates the detection of the trailing edge of overlapping objects.

Referring now to FIG. 5 and with continued reference to FIGS. 2A, 2B, 6A and 6B, there is shown the object 112 and the edge formed by the overlapping object 114. The overlapping object 114 may be an object similar to object 112 or may be something (such as a label) affixed to or associated with the surface of the object 112. As the objects 112 and 114 move along the defined path 110, a point is reached where the trailing edge defined by object 114 has just passed through the light beam 102. If the object 114 forms an edge whose height (thickness) is comparable to or greater than the diameter of the beam 102, the beam 102 will briefly be invisible to first light sensor 104. As such, the first light sensor 104 will receive little or no reflected light and the output of the first light sensor 104 will be reduced to zero or near zero causing signals "B-A" and "A BLK" to become active.

In addition, the rate of transition to zero (or near zero) of the first light sensor 104 will be sufficiently rapid to cause signal "A DIFF" to briefly become active. If the edge is sufficiently thick, the signals "B-A" and "A BLK" will remain active after the signal "A DIFF" has returned to the inactive state. The output signals resulting from this situation are shown in FIGS. 6A and 6B as the features defined as "Begin trail edge, other than thin object" indicated as feature "BT" and "Steady state, trail edge" indicated as feature "T".

With continued reference to FIGS. 5, 2A, 2B, 6A and 6B, if the edge thickness is significantly less than the diameter of the beam 102, the output of the first light sensor 104 will briefly be reduced, but not to zero or near zero. In this case, the signals "B-A" and "A DIFF" will become active, but signal "A BLK" will not become active. The output signals resulting from this situation are given in FIGS. 6A and 6B under the feature defined as "Begin trail edge, very thin object" indicated as feature "TBT".

With the above stated principles and relationships, the identification of a true leading edge can be determined by a pseudo-code equation given by:

A-B ^ B DIFF ^ (Length AB<Block-length AB v B BLK)

where "Length AB" is the length (duration) the signal "A-B" is active, and "Block-length AB" is the minimum length (duration) the signal "A-B" is active for which a true edge will cause signal "B BLK" to go active. The symbol "^" represents a logical "AND" function and the symbol "v" represents a logical "OR" function. As such, a true leading edge is detected when the signals "A-B" "B DIFF" and "B BLK" all are active (logic "1"). A true leading edge is also detected when the signals "A-B" and "B DIFF" are each active and the duration of the active signal "A-B" is less than the duration of the active signal "A-B" for which a true edge will cause signal "B BLK" to go active.

Similarly, a true trailing edge can be determined by the equation:

B-A ^ A DIFF ^ (Length BA<Block-length BA v A BLK)

where "Length BA" is the length (duration) the signal "B-A" is active, and "Block-length BA" is the minimum length (duration) the signal "B-A" is active for which a true edge will cause signal "A BLK" to go active. The symbol "^" represents a logical "AND" function and the symbol "v" represents a logical "OR" function. As such, a true leading edge is detected when the signals "B-A" "A DIFF" and "A BLK" all are active (logic "1"). A true leading edge is also detected when the signals "B-A" and "A DIFF" are each active and the duration of the active signal "B-A" is less than the duration of the active signal "B-A" for which a true edge will cause signal "A BLK" to go active.

Referring now to FIGS. 6A and 6B, it will be appreciated that in all features heretofore discussed, the edge features (TBL, TBT, BL, L, BT and T) are readily distinguished from the non-edge features (B, W, WB, and BW) solely by the presence or absence of an active "A-B" or "B-A" signal. Indeed, if all mail had uniformly flat surfaces, the only signals required would be signal "A-B", signal "B-A" and signal "C".

However, the surfaces of objects (mail pieces) are not uniformly flat. Mail pieces may be curved either due to bending or distortion of the envelope to accommodate thick content, due to damage in transport or handling, or due to other reasons. Because of this, the identification of edges in these situations requires more information and is made more complex. The reason a curved surface can be a problem is that while the beam is essentially lambertian and reflects equally in all directions, the energy actually received at each sensor is a function of the solid angle subtended by the beam. If the surface on which the beam is projected is tilted such that one light sensor "sees" a larger spot than the other light sensor "sees," the energy it receives will be commensurately greater. As a consequence, warps, wrinkles, and curves on the surface of an object, e.g., a mailpiece, can cause the outputs of signal "A-B" and signal "B-A" to exceed any practical threshold settings for these signals.

Thus, additional information is needed to determine when active signals on these lines (signal "A-B" or signal "B-A") indicate a true edge. This is accomplished by extracting additional information as previously described both from the "A-B" and "B-A" signals and from the amplified outputs of light sensors 104 and 106.

Figure 7A:
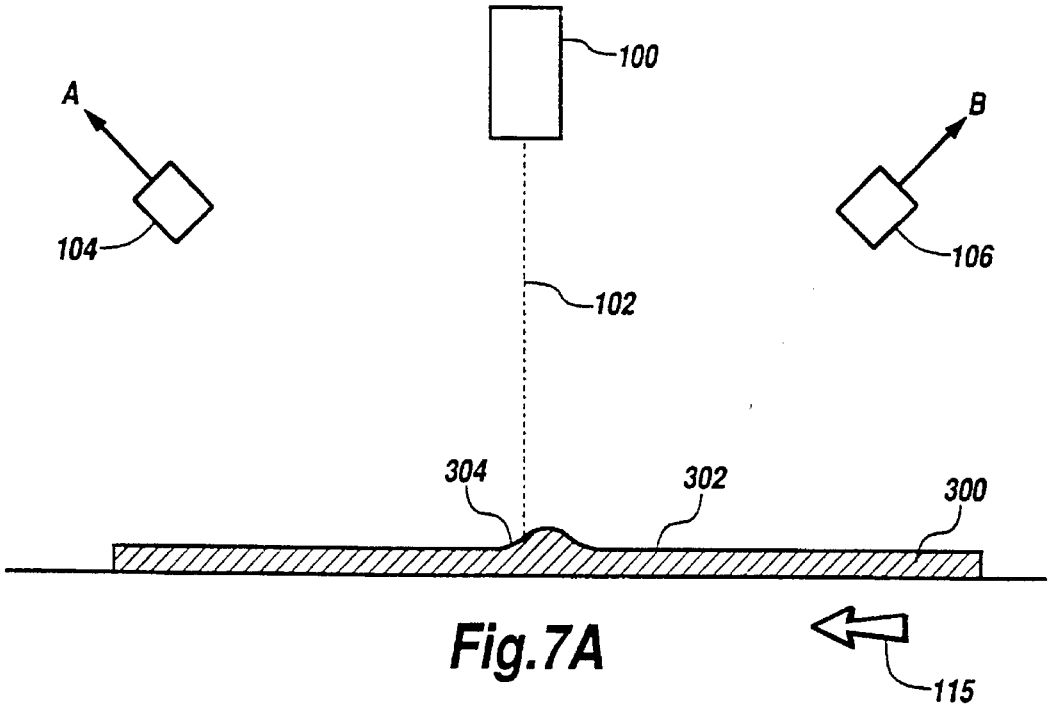
FIGS. 7A and 7B illustrate two different wrinkle configurations on the surface of an object as its rising surface passes through the light beam projected by the light source.
Figure 7B:
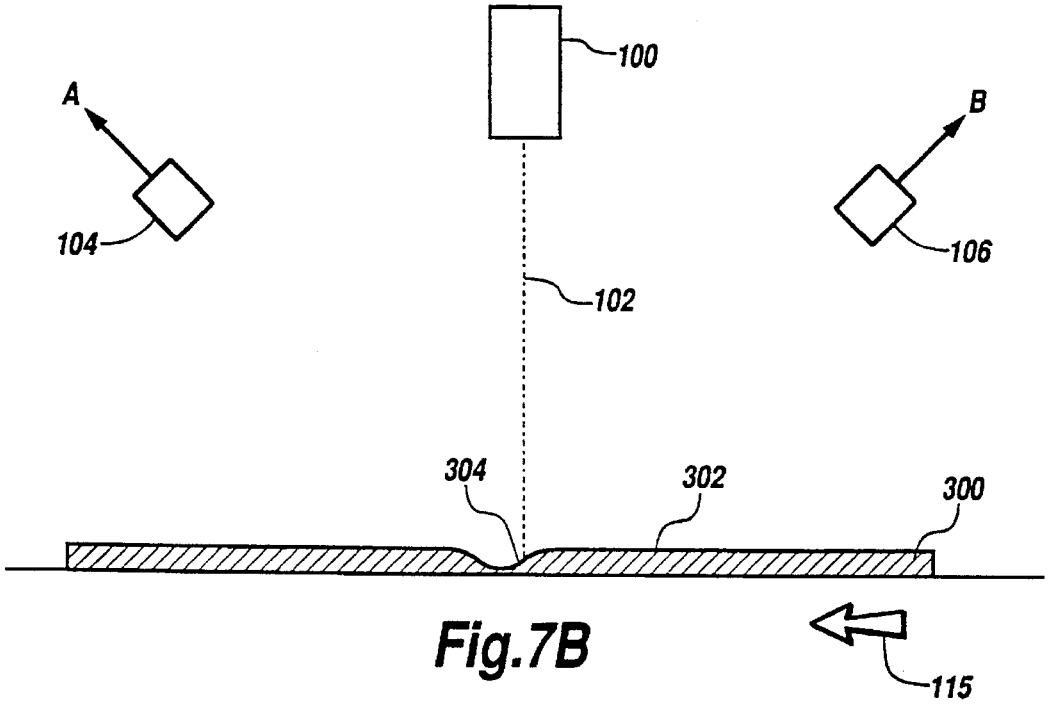

Referring now to FIGS. 7A and 7B, and with continued reference to FIGS. 2A, 2B, 6A, and 6B, there are illustrated two different wrinkle configurations on a surface 302 of an object 300 as a rising surface 304 passes through the light beam 102 projected by the light source. Note that the outputs of the first light sensor 104 and the second light sensor 106 are not equal as the beam 102 passes over a common wrinkle. When the beam 102 is positioned on a rising surface or edge 304, the output of the second light sensor 106 is relatively diminished because, from the perspective of the second light sensor 106, the solid angle subtended by the beam 102 is reduced. Conversely, the output of the first light sensor 104 is relatively augmented because, from the perspective of the first light sensor 104, the solid angle subtended by the beam 102 is increased. Thus, the differential amplifier 128 generates a non-zero output signal. If the pitch of the wrinkle is sufficiently large, the comparator generating signal "A-B" will produce an active (logic "1") output. This feature is defined as a "Wrinkle or warp, rising surface" indicated as feature "WR" in FIGS. 6A and 6B.

Figure 8A:
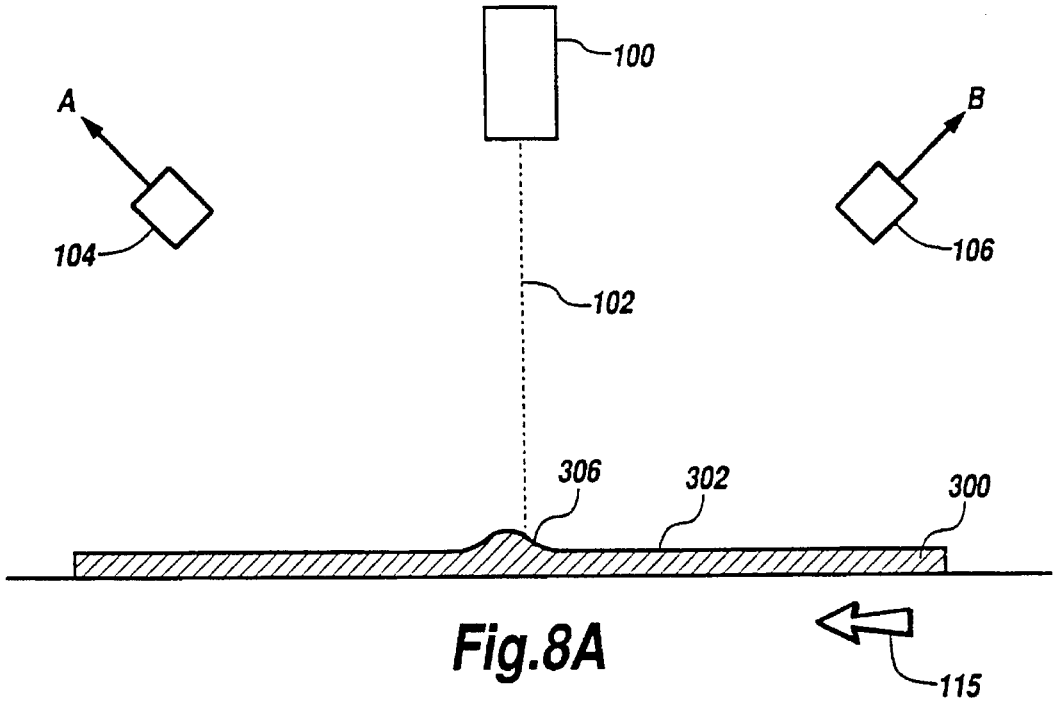
FIGS. 8A and 8B illustrate two different wrinkle configurations on the surface of an object as its falling surface passes through the light beam projected by the light source.
Figure 8B:
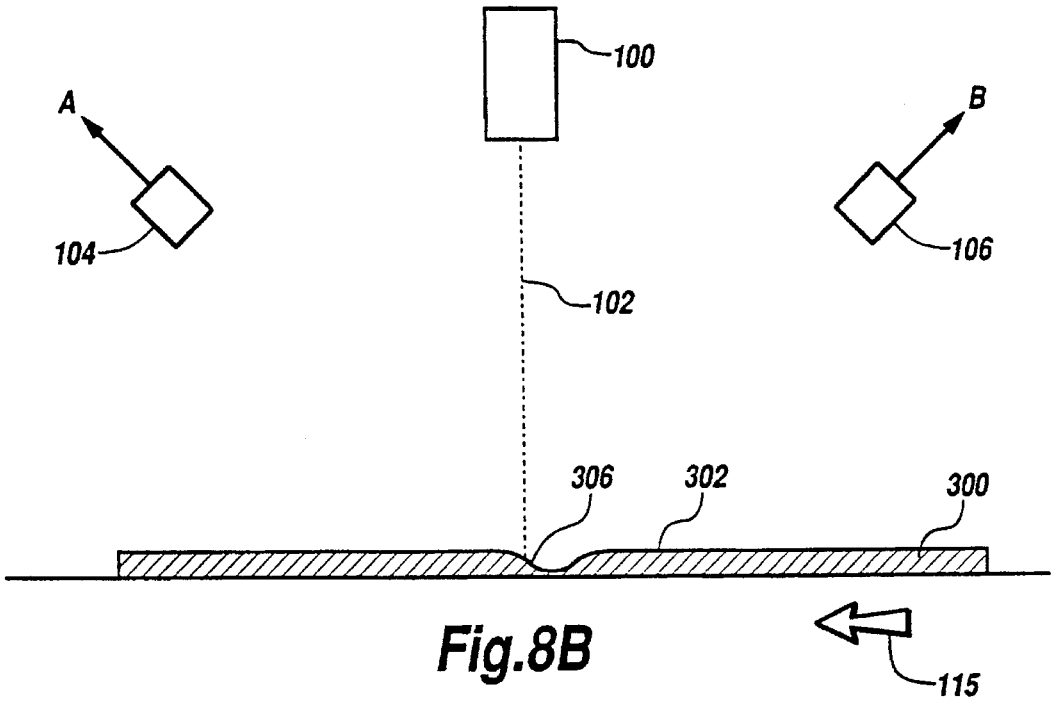

Referring now to FIGS. 8A and 8B, and with continued reference to FIGS. 2A, 2B, 6A, and 6B, there are illustrated two different wrinkle configurations on a surface 302 of an object 300 as a falling surface 306 passes through the light beam 102 projected by the light source. Similar to the situation described above for FIGS. 7A and 7B, the differential amplifier 130 generates a non-zero output signal. If the pitch of the wrinkle is sufficiently large, the comparator generating signal "B-A" will produce an active (logic "1") output. This feature is defined as a "Wrinkle or warp, falling surface" indicated as feature "WF" in FIGS. 6A and 6B.

For many wrinkles, the surface angle is relatively shallow. The signal "A DIFF" and the signal "B DIFF" in FIG. 2A (and shown in FIG. 6A) are active only when the output of the first light sensor 104 or the second light sensor 106 makes an abrupt, large-magnitude fall. However, in the case of a wrinkle having a relatively shallow surface angle, the signals "A DIFF" and "B DIFF" remain in the inactive (logic "0") state when the beam crosses the wrinkle. This makes it possible for the processor 404 to distinguish between an edge and a wrinkle by the inactive status of signal "A DIFF" or "B DIFF".

Figure 9A:
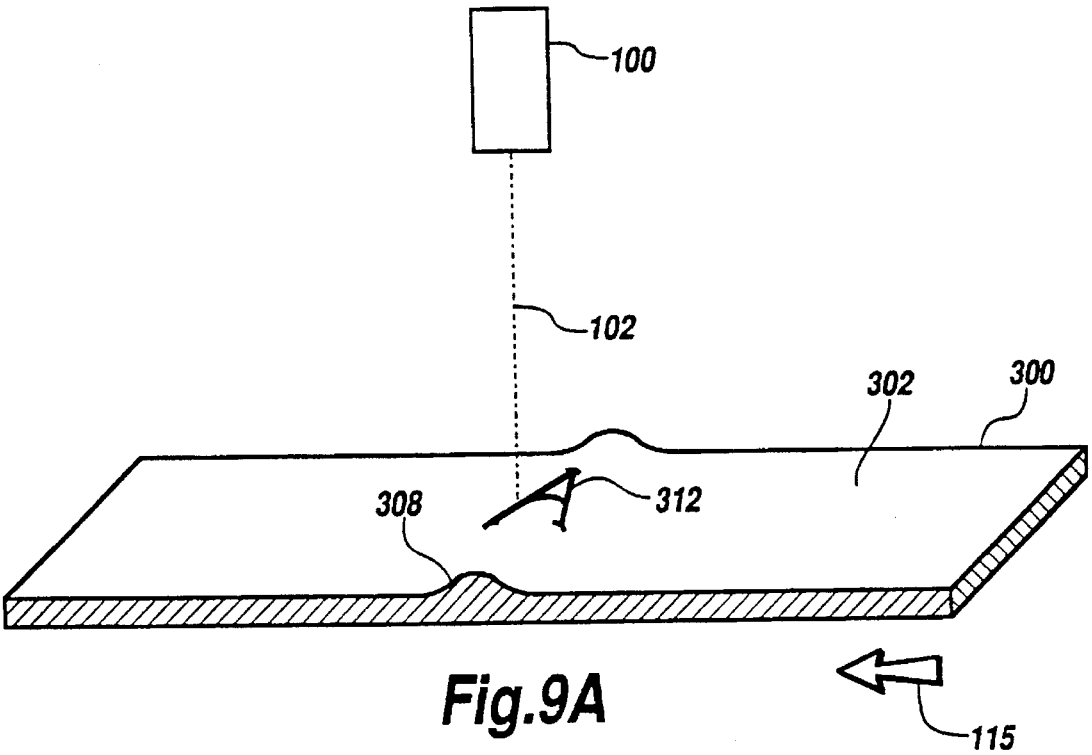
FIGS. 9A and 9B illustrate two different wrinkle configurations with a coincident white-to-black surface reflectance feature as the rising surface of the wrinkle passes through the light beam projected by the light source.
Figure 9B:
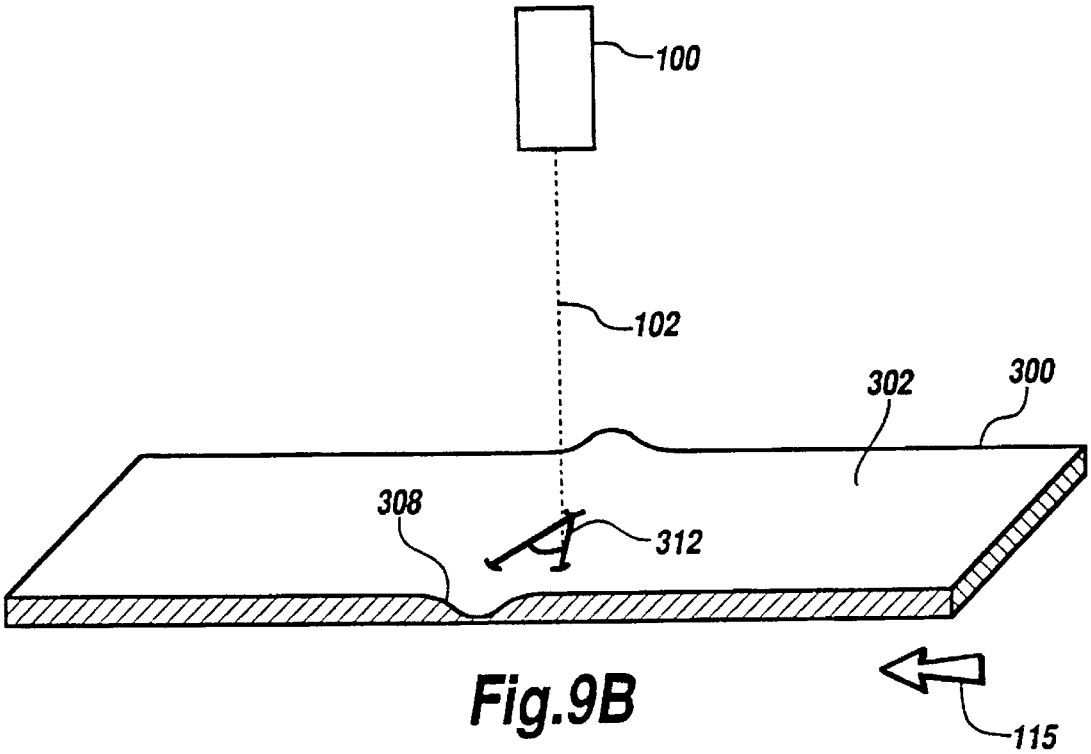

Referring now to FIGS. 9A and 9B, and with continued reference to FIGS. 2A, 2 B, 6A, and 6B, there are illustrated two different wrinkle configurations with a coincident white-to-black surface reflectance feature as a rising surface 308 of the wrinkle coincident with a white-to-black transition 312 (i.e. a printed character) passes through the light beam 102 projected by the light source. As will be appreciated, there are special (and not uncommon) combinations of features that can cause a short wrinkle to resemble a short leading edge (feature "TBL" in FIGS. 6A and 6B) more closely than in the preceding example. A wrinkle must be no longer than approximately the beam width of the light beam for any possibility of confusion, since otherwise, the absence of "B BLK" will be sufficient to make a clear differentiation. In fact, the circuit shown in FIG. 2A will generate a combination of signals as shown for the feature "White to black transition coincident with wrinkle or warp, rising surface" indicated as feature "WBWR" in FIG. 6A that could be confused with those associated with a short edge. A white-to-black transition that occurs coincident with the rising surface of a wrinkle, as illustrated in FIGS. 9A and 9B, may cause the signal "B DIFF" to go active coincident with an active "A-B" signal. The circuit described in FIG. 2A, however, usually in these cases, will generate an active "A DIFF" signal. This enables the processor 404 to distinguish the above-described coincident features from a true edge by the concurrently active "A DIFF" and "B DIFF" signals associated with the coincident features.

While the circuit shown in FIG. 2A satisfactorily produces the desired results in most applications, it has been determined that in certain applications additional circuitry is needed. Accordingly, the circuit shown in FIG. 2B has an additional means of discrimination.

As shown in FIG. 2B, the signal "B DIFF" is a composite of a signal "B1 DIFF" (the previous signal "B DIFF" in FIG. 2A) and a signal "B2 DIFF". Signal "B2 DIFF" is derived from the difference between the amplified outputs of the first light sensor 104 and the second light sensor 106. Since there is no significant difference in those signals for changes in surface reflectance, signal "B2 DIFF" does not become active when there is a white-to-black transition. Signal "B2 DIFF" only becomes active when there is a sufficiently large magnitude and rapid increase in the output of amplifier 128 (detected by the high pass filter 206 and the amplifier 208.

For a wrinkle, such as is illustrated in FIGS. 9A and 9B, the comparator 140 generating the signal "B2 DIFF" is adjusted such that this condition is rarely met, if at all. For additional discrimination of erroneous signals, signal "B2 DIFF" and signal "B1 DIFF" must be simultaneously active to generate an active "B DIFF" signal. Thus, for the circuit illustrated in FIG. 2B, the combination of features illustrated in FIGS. 9A and 9B require a very short wrinkle that must have a white-to-black transition that is coincident with a large magnitude, sharply-defined change in surface angle in order to produce a combination of signals that mimic those produced by a true leading edge. Accordingly, the circuit illustrated in FIG. 2B detects the wrinkle feature shown in FIGS. 9A and 9B unless it is a short wrinkle having a white-to-black transition that is coincident with a large magnitude change in surface angle.

Figure 10A:
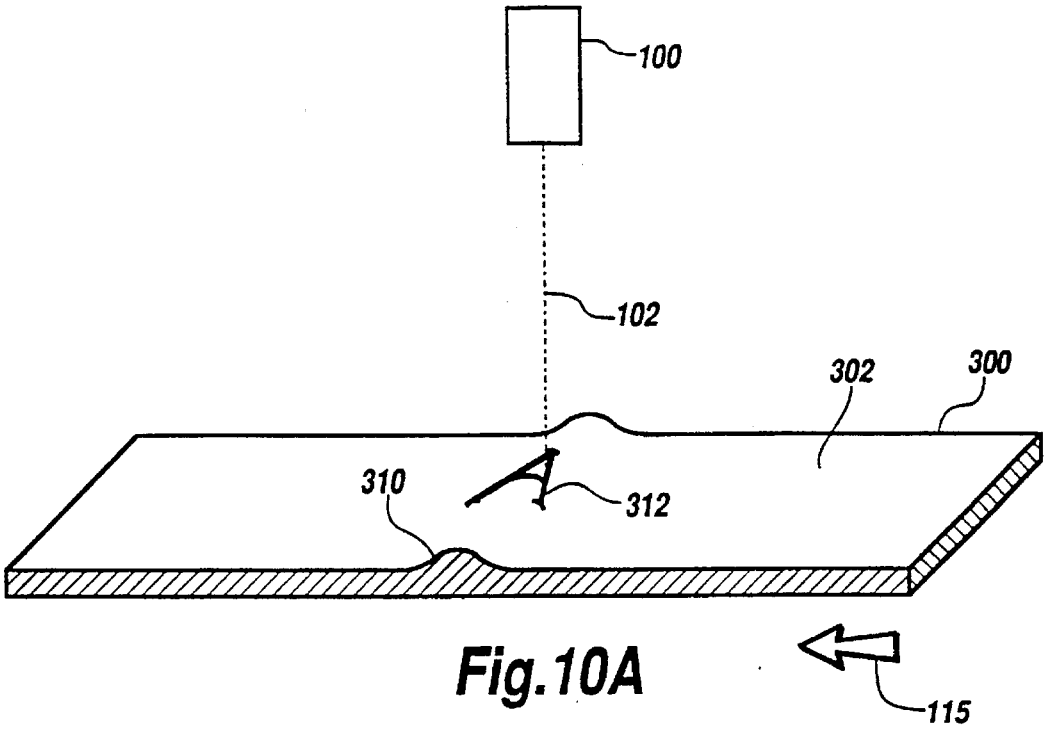
FIGS. 10A and 10B illustrates two different wrinkle configurations with a coincident white-to-black surface reflectance feature as the falling surface of the wrinkle passes through the light beam projected by the light source.
Figure 10B:
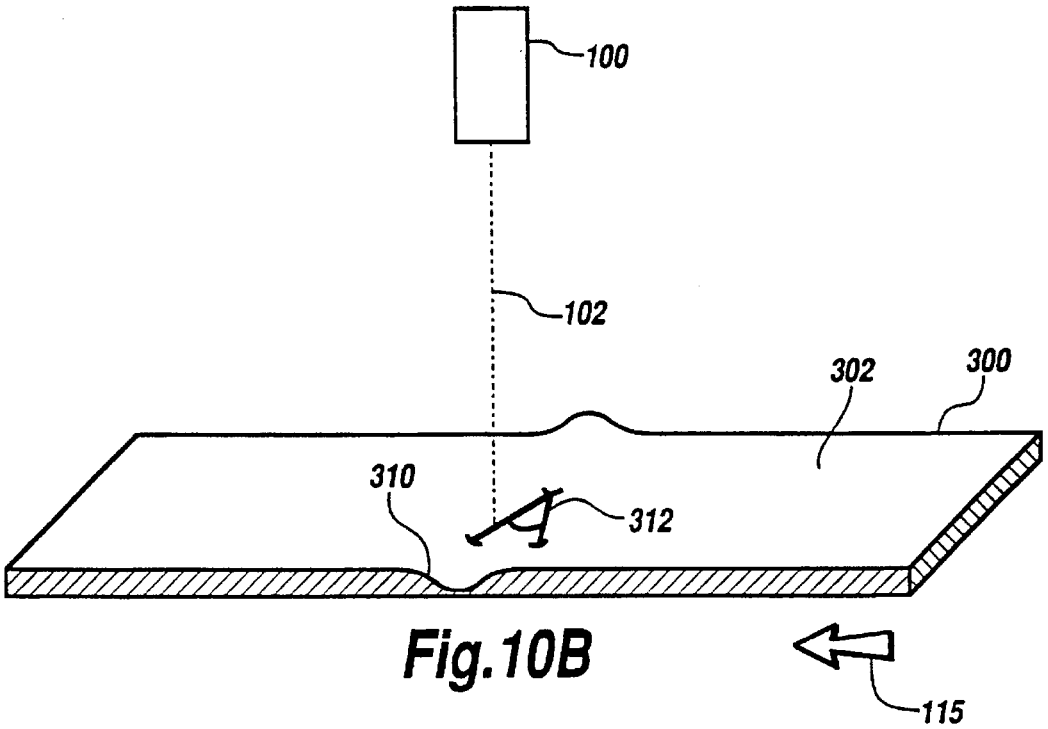

Referring now to FIGS. 10A and 10B, and with continued reference to FIGS. 2A, 2B, 6A, and 6B, there are illustrated two different wrinkle configurations with a coincident white-to-black surface reflectance feature as a falling surface 310 of the wrinkle coincident with a white-to-black transition 312 (i.e. a printed character) passes through the light beam projected by the light source. As will be appreciated, the same signals and logic used to discriminate between coincident white-to-black transitions and rising surfaces of wrinkles can be applied in the case of falling surfaces. That is, in both the truth table in FIG. 6A that corresponds with the circuit shown in FIG. 2A and the truth table in FIG. 6B that corresponds with the circuit in FIG. 2B, the processor 404 usually has sufficient information to discriminate between true edges and the coincident non-edge features.

Figure 11:
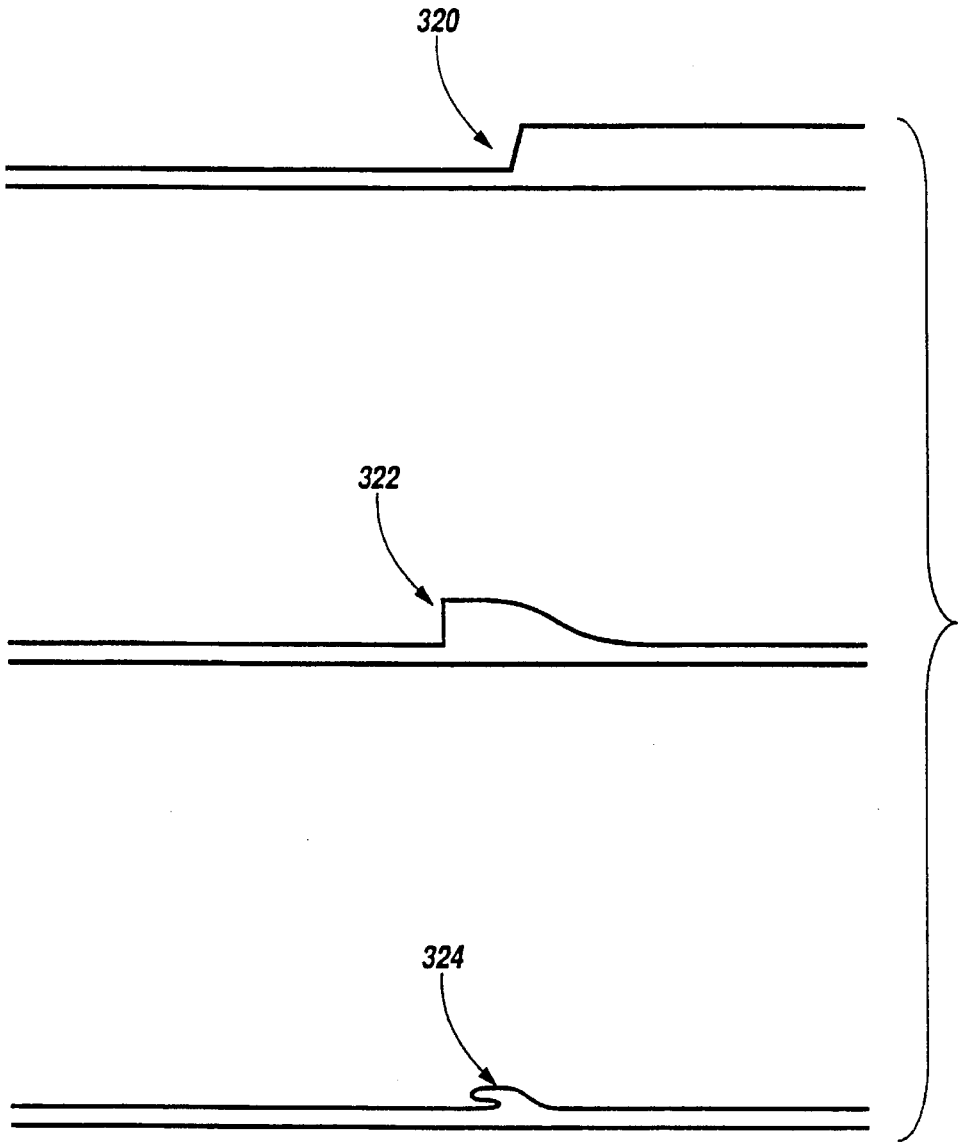
FIG. 11 illustrates various surface deformations that mimic a true leading or trailing edge.

Referring now to FIG. 11, and with continued reference to FIGS. 2A, 2B, 6A, and 6B, there are illustrated various surface deformations 320, 322, 324 that can mimic a true leading or trailing edge. It is possible for a surface to be deformed in the ways illustrated so as to approximate the three-dimensional characteristics of a true edge. In such cases, a single instance of the present invention will produce signals which are indistinguishable from those generated for true edges as shown for the features defined as "Extreme deformation, rising surface" indicated as feature "XDR" and "Extreme deformation, falling surface" indicated as feature "XDF" in FIGS. 6A and 6B. In cases when such surface deformations are common, a plurality of dichotomous scanning systems 400 may be used to additionally distinguish between true edges and such surface deformations. Additionally, the processor 404 may use the context of signal combinations to the same purpose.

Although several embodiments of the present invention have been described in the foregoing detailed description and illustrated in the accompanying drawings, it will be understood by those skilled in the art that the invention is not limited to the embodiments disclosed but is capable of numerous rearrangement, substitutions and modifications without departing from the spirit of the invention.

What is claimed is:

1. A method for detecting one object overlapping another object as the objects move along a defined path comprising the steps of:

directing a light beam toward the defined path;

receiving at a first light sensor light reflected from the object passing through the light beam;

receiving at a second light sensor light reflected from the object passing through the light beam;

generating a first output signal and a second output signal in response to the light received by the first light sensor and the second light sensor, respectively, said first output signal and said second output signal each having a magnitude related to the amount of light received by the first light sensor and the second light sensor, respectively;

generating a first information signal when the magnitude of the first output signal exceeds the magnitude of the second output signal;

generating a second information signal when the magnitude of the second output signal exceeds the magnitude of the first output signal;

generating a third information signal when the rate of change over time of the first output signal indicates an edge of the overlapping object passing through the light beam; and generating a fourth information signal when the rate of change over time of the second output signal indicates an edge of the overlapping object passing through the light beam.

2. A method in accordance with claim 1 wherein the step of generating the first information signal includes comparing the magnitude of the first output signal to the magnitude of the second output signal and the step of generating the second information signal includes comparing the magnitude of the second output signal to the magnitude of the first output signal.

3. A method in accordance with claim 2 wherein the step of generating the third information signal includes filtering with a first high pass filter the first output signal and the step of generating the fourth information signal includes filtering with a second high pass filter the second output signal.

4. A method for detecting one object overlapping another object as the objects move along a defined path comprising the steps of:

directing a light beam toward the defined path;

receiving at a first light sensor light reflected from the object passing through the light beam;

receiving at a second light sensor light reflected from the object passing through the light beam;

generating a first output signal and a second output signal in response to the light received by the first light sensor and the second light sensor, respectively, said first output signal and said second output signal each having a magnitude related to the amount of light received by the first light sensor and the second light sensor, respectively;

generating a first information signal when the magnitude of the first output signal exceeds the magnitude of the second output signal;

generating a second information signal when the magnitude of the second output signal exceeds the magnitude of the first output signal;

generating a third information signal when the rate of change over time of the first output signal indicates an edge of the overlapping object passing through the light beam; and generating a fourth information signal when the rate of change over time of the second output signal indicates an edge of the overlapping object passing through the light beam;

generating a fifth information signal for a nearly zero first output signal; and generating a sixth information signal for a nearly zero second output signal.

5. A method in accordance with claim 4 wherein the step of generating the first information signal includes comparing the magnitude of the first output signal to the magnitude of the second output signal and the step of generating the second information signal includes comparing the magnitude of the second output signal to the magnitude of the first output signal, and the step of generating the third information signal includes filtering with a first high pass filter the first output signal and the step of generating the fourth information signal includes filtering with a second high pass filter the second output signal.

6. A method for detecting one object overlapping another object as the objects move along a defined path path comprising the steps of:

directing a light beam toward the defined path;

receiving at a first light sensor light reflected from the object passing through the light beam;

receiving at a second light sensor light reflected from the object passing through the light beam;

receiving light at a third light sensor from the light beam;

generating a first output signal and a second output signal in response to the light received by the first light sensor and the second light sensor, respectively, said first output signal and said second output signal each having a magnitude related to the amount of light received the first light sensor and the second light sensor, respectively;

generating a first information signal when the magnitude of the first output signal exceeds the magnitude of the second output signal;

generating a second information signal when the magnitude of the second output signal exceeds the magnitude of the first output signal.

generating a third information signal when the rate of changover time of the first output signal indicates an edge of the overlapping object passing through the light beam; and generating a fourth information signal when the rate of change over time of the second output signal indicates an edge of the overlapping object passing through the light beam;

generating a fifth information signal for a nearly zero first output signal; and generating a sixth information signal for a nearly zero second output signal; and generating a seventh information signal when an object passes through the light beam preventing light from being received at the third light sensor, said seventh information signal indicating valid first through sixth information signals for determining whether an overlapping object exists.

7. A method for detecting one object overlapping another object as the objects move along a defined path comprising the steps of:

directing a light beam toward the defined path;

receiving at a first light sensor light reflected from the object passing through the light beam;

receiving at a second light sensor light reflected from the object passing through the light beam;

generating a first output signal and a second output signal in response to the light received by the first light sensor and the second light sensor, respectively, said first output signal and said second output signal each having a magnitude related to the amount of light received by the first light sensor and the second light sensor, respectively;

generating a first information signal when the magnitude of the first output signal exceeds the magnitude of the second output signal;

generating a second information signal when the magnitude of the second output signal exceeds the magnitude of the first output signal;

generating a third information signal when the rate of change over time of the first output signal and the rate of change over time of the second information signal indicates an edge of the overlapping object passing through the light beam; and generating a fourth information signal when the rate of change over time of the second output signal and the rate of change over time of the first information signal indicates an edge of the overlapping object passing through the light beam.

8. A method in accordance with claim 7 wherein the step of generating the first information signal includes comparing the magnitude of the first output signal to the magnitude of the second output signal and the step of generating the second information signal includes comparing the magnitude of the second output signal to the magnitude of the first output signal, and the step of generating the third information signal includes filtering with a first high pass filter the first output signal and filtering with a second high pass filter the second information signal, and the step of generating the fourth information signal includes filtering with a third high pass filter the second output signal and filtering with a fourth high pass filter the first information signal.

9. A method for detecting one object overlapping another object as the objects move along a defined path comprising the steps of:

directing a light beam toward the defined path;

receiving at a first light sensor light reflected from the object passing through the light beam;

receiving at a second light sensor light reflected from the object passing through the light beam;

generating a first output signal and a second output signal in response to the light received by the first light sensor and the second light sensor, respectively, said first output signal and said second output signal each having a magnitude related to the amount of light received by the first light sensor and the second light sensor, respectively;

generating a first information signal when the magnitude of the first output signal exceeds the magnitude of the second output signal;

generating a second information signal when the magnitude of the second output signal exceeds the magnitude of the first output signal;

generating a third information signal when the rate of change over time of the first output signal and the rate of change over time of the second information signal indicates an edge of the overlapping object passing through the light beam; and generating a fourth information signal when the rate of change over time of the second output signal and the rate of change over time of the first information signal indicates an edge of the overlapping object passing through the light beam generating a fifth information signal for a nearly zero first output signal; and generating a sixth information signal for a nearly zero second output signal.

10. A method for detecting one object overlapping another object as the objects move along a defined path comprising the steps of:

directing a light beam toward the defined path;

receiving at a first light sensor light reflected from the object passing through the light beam;

receiving at a second light sensor light reflected from the object passing through the light beam;

receiving light at a third light sensor from the light beam;

generating a first output signal and a second output signal in response to the light received by the first light sensor and the second light sensor, respectively, said first output signal and said second output signal each having a magnitude related to the amount of light received by the first light sensor and the second light sensor, respectively;

generating a first information signal when the magnitude of the first output signal exceeds the magnitude of the second output signal;

generating a second information signal when the magnitude of the second output signal exceeds the magnitude of the first output signal;

generating a third information signal when the rate of change over time of the first output signal and the rate of change over time of the second information signal indicates an edge of the overlapping object passing through the light beam; and generating a fourth information signal when the rate of change over time of the second output signal and the rate of change over time of the first information signal indicates an edge of the overlapping object passing through the light beam;

generating a fifth information signal for a nearly zero first output signal; and generating a sixth information signal for a nearly zero second output signal; and generating a seventh information signal when an object passes through the light beam preventing light from being received at the third light sensor, said seventh information signal indicating when the first through sixth information signals are valid for determining whether an overlapping object exists.

11. An electro-optical overlapped object detector for detecting one object overlapping another object as the objects move along a defined path comprising:

a light source for projecting a light beam toward the path;

a first light sensor oriented to receive light reflected from the object passing through the light beam, said first light sensor outputting a first output signal having a magnitude related to the amount of reflected light received by said first light sensor;

a second light sensor oriented to receive light reflected from the object passing through the light beam, said second light sensor outputting a second output signal having a magnitude related to the amount of reflected light received by said second light sensor; and information means for generating a first information signal when the light received by the first light sensor exceeds the amount of light received by the second light sensor, said information means generating a second information signal when the light received by the second light sensor exceeds the amount of light received by the first light sensor, said information means generating a third information signal when the rate of change over time of the light received by the first light sensor indicates an edge of the overlapping object passing through the light beam, and said information means generating a fourth information signal when the rate of change over time of the light received by the second light sensor indicates an edge of the overlapping object passing through the light beam.

12. An electro-optical overlapped object detector in accordance with claim 11 wherein the information means comprises a first differential amplifier for generating the first information signal, and a second differential amplifier for generating the second information signal.

13. An electro-optical overlapped object detector in accordance with claim 12 wherein the information means comprises a first high pass filter for generating the third information signal, and a second high pass filter for generating a fourth information signal.

14. An electro-optical overlapped object detector for detecting one object overlapping another object as the objects move along a defined path comprising:

a light source for projecting a light beam toward the path;

a first light sensor oriented to receive light reflected from the object passing through the light beam, said first light sensor outputting a first output signal having a magnitude related to the amount of reflected light received by said first light sensor;

a second light sensor oriented to receive light reflected from the object passing through the light beam, said second light sensor outputting a second output signal having a magnitude related to the amount of reflected light received by said second light sensor; and information means for generating a first information signal when the light received by the first light sensor exceeds the amount of light received by the second light sensor, said information means generating a second information signal when the light received by the second light sensor exceeds the amount of light received by the first light sensor, said information means generating a third information signal when the rate of change over time of the light received by the first light sensor indicates an edge of the overlapping object passing through the light beam, said information means generating a fourth information signal when the rate of change over time of the light received by the second light sensor indicates an edge of the overlapping object passing through the light beam, said information means generating a fifth information signal when the light received by the first light sensor approaches zero, and said information means generating a sixth information signal when light received by the second light sensor approaches zero.

15. An electro-optical overlapped object detector in accordance with claim 14 wherein the information means comprises a first differential amplifier for generating the first information signal, a second differential amplifier for generating the second information signal, a first high pass filter for generating the third information signal, and a second high pass filter for generating a fourth information signal.

16. An electro-optical overlapped object detector for detecting one object overlapping another object as the objects move along a defined path comprising:

a light source for projecting a light beam toward the path;

a first light sensor oriented to receive light reflected from the object passing through the light beam, said first light sensor outputting a first output signal having a magnitude related to the amount of reflected light received by said first light sensor;

a second light sensor oriented to receive light reflected from the object passing through the light beam, said second light sensor outputting a second output signal having a magnitude related to the amount of reflected light received by said second light sensor;

a third light sensor positioned and oriented to receive light directly from the light source when no object reflects the light beam;

information means for generating a first information signal when the light received by the first light sensor exceeds the amount of light received by the second light sensor, said information means generating a second information signal when the light received by the second light sensor exceeds the amount of light received by the first light sensor, said information means generating a third information signal when the rate of change over time of the light received by the first light sensor indicates an edge of the overlapping object passing through the light beam, said information means generating a fourth information signal when the rate of change over time of the light received by the second light sensor indicates an edge of the overlapping object passing through the light beam, said information means generating a fifth information signal when the light received by the first light sensor approaches zero, said information means generating a sixth information signal when light received by the second light sensor approaches zero, and said information means generating a seventh information signal by an object positioned to reflect the light beam, said seventh information signal indicating when the first through sixth information signals are valid for determining whether an overlapping object exists.

17. An electro-optical overlapped object detector for detecting one object overlapping another object as the objects move along a defined path comprising:

a light source for projecting a light beam toward the path;

a first light sensor oriented to receive light reflected from the object passing through the light beam, said first light sensor outputting a first output signal having a magnitude related to the amount of reflected light received by said first light sensor;

a second light sensor oriented to receive light reflected from the object passing through the light beam, said second light sensor outputting a second output signal having a magnitude related to the amount of reflected light received by said second light sensor; and information means for generating a first information signal when the light received by the first light sensor exceeds the amount of light received by the second light sensor, said information means generating a second information signal when the light received by the second light sensor exceeds the amount of light received by the first light sensor, said information means generating a third information signal when both the rate of change over time of the light received by the first light sensor and the rate of change over time of the second information signal indicate an edge of the overlapping object passing through the light beam, and said information means generating a fourth information signal when the rate of change over time of the light received by the second light sensor and the rate of change over time of the first information signal indicate an edge of the overlapping object passing through the light beam.

18. An electro-optical overlapped object detector in accordance with claim 17 wherein the information means comprises a first differential amplifier for generating the first information signal, a second differential amplifier for generating the second information signal, a first high pass filter for generating the third information signal, and a second high pass filter for generating a fourth information signal.

19. An electro-optical overlapped object detector for detecting one object overlapping another object as the objects move along a defined path comprising:

a light source for projecting a light beam toward the path;

a first light sensor oriented to receive light reflected from the object passing through the light beam, said first light sensor outputting a first output signal having a magnitude related to the amount of reflected light received by said first light sensor;

a second light sensor oriented to receive light reflected from the object passing through the light beam, said second light sensor outputting a second output signal having a magnitude related to the amount of reflected light received by said second light sensor; and information means for generating a first information signal when the light received by the first light sensor exceeds the amount of light received by the second light sensor, said information means generating a second information signal when the light received by the second light sensor exceeds the amount of light received by the first light sensor, said information means generating a third information signal when both the rate of change over time of the light received by the first light sensor and the rate of change over time of the second information signal indicate an edge of the overlapping object passing through the light beam, said information means generating a fourth information signal when the rate of change over time of the light received by the second light sensor and the rate of change over time of the first information signal indicate an edge of the overlapping object passing through the light beam, said information means generating a fifth information signal when the light received by the first light sensor is nearly zero, and said information means generating a sixth information signal when light received by the second light sensor approaches zero.

20. An electro-optical overlapped object detector for detecting one object overlapping another object as the objects move along a defined path comprising:

a light source for projecting a light beam toward the path;

a first light sensor oriented to receive light reflected from the object passing through the light beam, said first light sensor outputting a first output signal having a magnitude related to the amount of reflected light received by said first light sensor;

a second light sensor oriented to receive light reflected from the object passing through the light beam, said second light sensor outputting a second output signal having a magnitude related to the amount of reflected light received by said second light sensor;

a third light sensor positioned and oriented to receive light directly from the light source when no object is reflecting the light beam; and information means for generating a first information signal when the light received by the first light sensor exceeds the amount of light received by the second light sensor, said information means generating a second information signal when the light received by the second light sensor exceeds the amount of light received by the first light sensors said information means generating a third information signal when both the rate of change over time of the light received by the first light sensor and the rate of change over time of the second information signal indicate an edge of the overlapping object passing through the light beam, said information means generating a fourth information signal when the rate of change over time of the light received by the second light sensor and the rate of change over time of the first information signal indicate an edge of the overlapping object passing through the light beam, said information means generating a fifth information signal when the light received by the first light sensor is nearly zero, said information means generating a sixth information signal when light received by the second light sensor approaches zero and said information means generating a seventh edge information signal when an object is positioned to reflect the light beam, said seventh information signal indicating when the first through sixth information signals are valid for determining whether an overlapping object exists.

* * * * *